US007635507B2

(12) United States Patent
Noge et al.

(10) Patent No.: US 7,635,507 B2
(45) Date of Patent: Dec. 22, 2009

(54) RECEIVING PAPER FOR THERMAL TRANSFER RECORDING AND MANUFACTURING METHOD THEREOF

(75) Inventors: Yoshifumi Noge, Numazu (JP); Shigeru Miyajima, Fuji (JP)

(73) Assignee: Ricoh Company, Ltd., Tokyo (JP)

( * ) Notice: Subject to any disclaimer, the term of this patent is extended or adjusted under 35 U.S.C. 154(b) by 1025 days.

(21) Appl. No.: 10/634,551

(22) Filed: Aug. 5, 2003

(65) Prior Publication Data

US 2004/0063579 A1 Apr. 1, 2004

(30) Foreign Application Priority Data

Aug. 5, 2002 (JP) ..... 2002-227690

(51) Int. Cl.
*B41M 5/40* (2006.01)

(52) U.S. Cl. ..... 428/32.39; 428/32.5

(58) Field of Classification Search .... 428/32.39–32.52
See application file for complete search history.

(56) References Cited

U.S. PATENT DOCUMENTS

| | | | | |
|---|---|---|---|---|
| 5,155,090 | A | 10/1992 | Aono et al. | |
| 5,229,189 | A | 7/1993 | Hiyoshi et al. | |
| 5,229,349 | A | 7/1993 | Kurisu et al. | |
| 5,250,346 | A | 10/1993 | Nagai et al. | |
| 5,413,854 | A * | 5/1995 | Sato | 428/32.39 |
| 5,508,108 | A * | 4/1996 | Tokiyoski et al. | 428/32.39 |
| 5,631,076 | A * | 5/1997 | Hakomori et al. | 428/32.39 |
| 5,716,477 | A | 2/1998 | Yamaguchi et al. | |
| 6,117,562 | A | 9/2000 | Yamaguchi et al. | |
| 6,214,458 | B1 * | 4/2001 | Kobayashi et al. | 428/32.5 |
| 6,780,479 | B2 * | 8/2004 | Katsuoka et al. | 428/32.39 |
| 2003/0133004 | A1 | 7/2003 | Miyajima et al. | |

FOREIGN PATENT DOCUMENTS

| | | |
|---|---|---|
| EP | 0618080 | 10/1994 |
| EP | 0751005 | 1/1997 |
| JP | 05-208562 | 8/1993 |
| JP | 05-208563 | 8/1993 |
| JP | 2001-199171 | 7/2001 |

OTHER PUBLICATIONS

U.S. Appl. No. 08/548,478, filed Oct. 26, 1995, claims & abstract only, Abn.
U.S. Appl. No. 07/805,046, filed Dec. 11, 1991, claims & abstract only, Abn.
Patent Abstracts of Japan, vol. 016, No - 299 (b1-1274) , Jul. 2, 1992.
Abstract of JP 04082790, Mar. 1, 1992.
European Search Report, EP 03017750.5-125I-, Nov. 03, 2003.

* cited by examiner

*Primary Examiner*—Bruce H. Hess
(74) *Attorney, Agent, or Firm*—Cooper & Dunham LLP

(57) ABSTRACT

A receiving paper for thermal transfer recording, having a paper substrate; an ink receiving layer located overlying one side of the paper substrate and configured to receive a heat-melted or heat-softened ink; and a tackifying layer located overlying another side of the substrate, wherein the ink receiving layer is formed by coating an ink receiving layer forming liquid including a resin emulsion overlying the paper substrate; and heating the coating of ink layer forming liquid to a temperature not less than a minimum filming temperature of the resin emulsion.

9 Claims, No Drawings

RECEIVING PAPER FOR THERMAL TRANSFER RECORDING AND MANUFACTURING METHOD THEREOF

BACKGROUND OF THE INVENTION

1. Field of the Invention

The present invention relates to a receiving paper for thermal transfer recording, which is used in combination with a thermal transfer recording medium including a thermofusible ink layer. Specifically the present invention relates to a receiving label for thermal transfer recording.

2. Discussion of the Related Art

Conventionally, various thermal transfer recording methods are known. For example, a method is proposed which uses a thermal transfer recording medium including a thermofusible ink layer and forming various information and images on labels such as papers and plastic films including an ink receiving layer. In particular, the thermal recording method is widely used for applications to an industrial field such that bar codes are printed by a thermal recording medium on a receiving material to be used for name plates, process control and logistic control. Since resistance to organic solvents, water, abrasion and chemical agents is required for the recorded images in the above-mentioned applications, plastic films such as polyester, polypropylene, polyethylene or synthetic papers are widely used as receiving materials. The thermal transfer recording medium for use for such applications typically includes an ink layer including a thermoplastic polymer as a main component so that the resultant images can resist the above-mentioned stresses and chemicals.

However, there is a problem in that plastic films used as receiving materials are expensive and therefore have a narrow range of applications. In addition, there is another problem in that labels using a natural fiber paper such as high quality papers or middle quality papers have poor ink receivability and fixability when a thermal transfer recording medium having an ink layer is used, which ink layer includes a thermoplastic polymer as a main component.

In contrast, for the purpose of improving the receivability of labels using a natural fiber paper as a substrate, many types of receiving materials have been proposed, which include an ink receiving layer having good thermofusible ink receivability on a substrate.

However, when these methods are used, resistance of the recorded images to organic solvents, abrasion and water is not satisfactory. In addition, when an adhesive layer is formed on the back surface of such a receiving material that is prepared by these methods to be used as a label, there is a problem in that because the substrate and the ink receiving layer do not have barriers against organic solvents and water, the adhesiveness of the adhesive layer on the back surface deteriorates due to the organic solvents and water, and thereby the label does not function as a label.

In contrast, published unexamined Japanese Patent Application No. 2001-199171 discloses a technology in which the binder resin in an ink layer and the binder resin used as main component of an ink receiving layer are of the same kind, and the SP value thereof are specified. In this technology, although recorded images have good resistance to organic solvents, abrasion and water, usability for users deteriorates because the ink and the receiving material have to be used as a combination and the range of applications thereof is extremely narrow.

In addition, published unexamined Japanese Patent Application No. H5-208562 proposes a provision of an intermediate layer having resistance to solvents between a substrate and an ink receiving layer using a polyvinyl alcohol having a degree of polymerization of from 50 to 450. In addition, published unexamined Japanese Patent Application No. H5-208563 proposes including an intermediate layer, which is formed of a polyvinyl alcohol having a hydrophobic group in an amount of from 18 to 80% by mole.

However, in the method in which an intermediate layer of a polyvinyl alcohol having a degree of polymerization of from 50 to 450 is used, the degree of polymerization is low, and therefore the film forming property is not satisfactory and the resistance to organic solvents is not satisfactory. In addition, since the materials used have high solubility to water, there is a problem in that when the materials are brought into contact with water, the intermediate layer dissolves and the layer is peeled off, resulting in that the receiving paper has poor water resistance. In addition, there is another problem in that since the intermediate layer has low polymerization, adhesiveness of the film is strong and the intermediate layer adheres to feeding rollers during coating, thereby decreasing productivity.

In addition, the method in which an intermediate layer of polyvinyl alcohol having a hydrophobic group in an amount of from 18 to 80% by mole is used has a drawback in that the higher the hydrophobic group content, the lower the resistance to organic solvents, and further, this method cannot provide a satisfactory resistance to organic solvents and water for the resultant images.

Because of these reasons, a need exists for an inexpensive label for thermal transfer recording on which images having good resistance to organic solvents, water and abrasion can be formed when the label is used as a label having a tackifying layer on the back surface thereof.

SUMMARY OF THE INVENTION

Accordingly, an object of the present invention is to provide an inexpensive label for thermal transfer recording which overcomes drawbacks of the conventional labels in that images recorded on the labels do not have good resistance to organic solvents, water and abrasion, and the labels themselves do not have good resistance to organic solvents and water when used as labels having a tackifying layer on the back surface thereof.

To achieve such an object, the present invention contemplates the provision of a receiving paper for thermal transfer recording, including:

a paper substrate having opposed surfaces;

an ink receiving layer located overlying one surface of the paper substrate, and configured to receive a heat-melted or heat-softened ink; and a tackifying layer located overlying another surface of the paper substrate, wherein the ink receiving layer is formed by a method including:

providing a coating of an ink receiving layer forming liquid including a resin emulsion overlying the paper substrate, the emulsion having a minimum filming temperature; and heating the coating of ink receiving layer forming liquid to a temperature not less than the minimum filming temperature of the resin emulsion.

The resin of the resin emulsion preferably has a glass transition point not less than 45° C.

The resin emulsion is preferably an emulsion of a resin selected from the group consisting of polyesters and urethanes.

It is preferable that the ink receiving layer further includes a hollow particulate material having a hollow rate not less than 50%.

In addition, the ink receiving layer preferably has a surface having a smoothness not less than 500 seconds when measured by an Ohken-shiki smoothness tester.

The receiving paper for thermal transfer recording preferably includes an intermediate layer which is formed between the paper substrate and the ink receiving layer and/or between the paper substrate and the tackifying layer, by coating one surface or the other of the paper substrate with an intermediate layer including a water-soluble or water-dispersible resin and a curing agent as main components.

The water-soluble or water-dispersible resin in the intermediate layer is preferably a polyvinyl alcohol or a modified polyvinyl alcohol.

In another aspect, the invention contemplates the provision of a method for manufacturing a receiving paper for thermal transfer recording, including:

providing a coating of an ink receiving layer forming liquid including a resin emulsion overlying a surface of a paper substrate having opposed surfaces, the emulsion having a minimum filming temperature;

heating the coating of ink receiving layer forming liquid to a temperature not less than a minimum filming temperature of the resin emulsion, thereby to form an ink receiving layer; and forming a tackifying layer overlying another surface of the paper substrate.

The resin of the resin emulsion preferably has a glass transition point not less than 45° C.

The resin emulsion is preferably an emulsion of a resin selected from the group consisting of polyesters and urethanes.

It is preferable that the ink receiving layer further includes a hollow particulate material having a hollow rate not less than 50%.

In addition, the ink receiving layer preferably has a surface having a smoothness not less than 500 seconds when measured by an Ohken-shiki smoothness tester.

It is preferable that the method further includes:

forming an intermediate layer including water-soluble or water-dispersible resin and a curing agent thereof as main components between the substrate and the ink receiving layer, and/or between the substrate and the tackifying layer.

The water-soluble resin in the intermediate layer is preferably a polyvinyl alcohol or a modified polyvinyl alcohol.

These and other objects, features and advantages of the present invention will become apparent upon consideration of the following description of the preferred embodiments of the present invention.

DESCRIPTION OF THE PREFERRED EMBODIMENTS

Generally, the present invention provides a label for thermal transfer recording, including a paper substrate; an ink receiving layer located overlying one side of the paper substrate, which ink receiving layer receives a heat-melted or heat-softened ink; and a tackifying layer located overlying another side of the substrate.

A base paper for use in the present invention as the paper substrate is generally formed of a wood pulp and a filler as main components. Specific examples of the wood pulp include chemical pulps such as LBKP and NBKP, mechanical pulps such as GP, PGW, RMP, TMP, CTMP, CMP and CGP, and recycled waste-paper pulp such as DIP. One or more of any conventionally known additives such as pigments, binders, sizing agents or fixing agents, yield improving agents, cationization agents, and paper strength improving agents can be added if desired. The paper can be produced by using the mixture thereof and an apparatus such as fourdrinier machines, cylinder machines, and twin-wired machines. The paper can be acidic, neutral or alkaline. In addition, the base paper may be on-machine treated by a calendaring apparatus consisted of a metallic roll and a synthetic resin roll. The base paper may be off-machine treated, i.e., may be calendared by a machine calendar or a super calendar to control the surface flatness thereof.

In the present invention, since the tackifying layer provided on a back surface of the substrate does not need resistance to organic solvents, an adhesive agent used in normal labels can be used, however, acrylic resin emulsions are preferably used.

In addition, a heat-activating type adhesive agent which does not need a release paper, for example, a tackifying layer formed of a thermoplastic resin and a solid plasticizer can also be used as the tackifying layer.

The ink receiving layer forming liquid for use in the present invention includes a resin emulsion. In a manufacturing process of forming this ink receiving layer, after an ink receiving layer forming liquid is coated on a substrate to provide a surface coating of ink receiving layer material, the ink receiving layer is manufactured by using a process in which the temperature of the surface coating of ink receiving layer material is heated to a temperature not less than a MFT of the emulsion. MFT means a minimum filming temperature, and the emulsion forms a continuous film when the emulsion is heated to a temperature not less than the MFT thereof. When the temperature of the emulsion is less than the MFT, the emulsion does not form a continuous film, even if a solvent of the emulsion evaporates. It is believed that the same is true for the manufacturing process of the ink receiving layer. And even when the ink receiving layer forming liquid is coated on the substrate and then dried to evaporate the solvent of the emulsion, the emulsion forms a discontinuous layer, if the drying temperature is lower than the MFT of the emulsion. A continuous film can be formed by using a process in which the temperature of the surface coating of ink receiving layer material is controlled to be not less than the MFT of the emulsion. It is preferable to perform the process in which the temperature of the surface coating of ink receiving layer material is controlled to be not less than the MFT of the emulsion, just after drying process (evaporation of the solvent of the emulsion). By using this method, the manufacturing process can be simplified.

An effect of providing the process in which the temperature of the surface coating of ink receiving layer material is controlled to be not less than the MFT of the emulsion is that forming a continuous layer of the resin in the ink receiving layer imparts relatively high resistance to organic solvents, water and abrasion to the images recorded thereon, and relatively high resistance to organic solvents and water to the receiving material when it is used as a label having a tackifying layer on the back surface thereof, compared to a case where the resin forms a discontinuous layer. The reason therefor is considered to be as follows. Forming a continuous layer of a resin increases a mechanical strength of the ink receiving layer. In addition, when the ink receiving layer is heated at a temperature in the below-mentioned range and then cooled, a dense ink receiving layer can be formed. In addition, the solubility of the ink receiving layer to organic solvents and water decreases (i.e., the resistance thereto is improved). Further, by using a specific resin emulsion, the resistance to organic solvents and water can be further improved and the surface of the ink receiving layer can be smoothed.

Resistance of a recorded image to organic solvents and water can deteriorate even when a resin in an ink receiving layer dissolves only a little to organic solvents or water. In addition, resistance to abrasion deteriorates if the ink receiving layer has weak mechanical strength. Furthermore, when a receiving paper is used as a label, organic solvents and water tend to penetrate to a back surface of the receiving paper, because the resin in the ink receiving layer dissolves to the organic solvents and water, resulting in deterioration of adhesive function of the tackifying layer. However, when the resin in the ink receiving layer forms a continuous layer, such a problem hardly occurs.

When the temperature of the coating of ink receiving layer forming liquid exceeds the MFT of the resin emulsion and becomes much higher than the MFT, drying of the ink receiving layer proceeds, and the water content decreases, while the resin is softened, resulting in formation of a rough coating surface. Such a phenomenon tends to occur when the temperature of the coating of ink receiving layer forming liquid is higher than a temperature 50° C. or more higher than the MFT of the emulsion. Therefore, the temperature of the ink receiving layer is preferably not higher than the MFT by 50° C. or more. If the coating surface is rough, printing qualities deteriorate when small characters and thin lines are printedby a thermal transfer recording medium. Even when the rough surface is subjected to a calendering treatment, the above deterioration of the printing qualities cannot be decreased. Therefore, it is important to control the temperature of the coating surface.

The resin of the resin emulsion for use in the receiving paper of the present invention preferably has a glass transition point not less than 45° C. so that the resultant ink receiving layer has an improved anti-blocking property. In this case, the "blocking" means an adhesive phenomenon between the ink receiving layer and a surface of the receiving paper contacting therewith when the receiving paper is stored in the roll form. It is considered to use an emulsion having a low MFT in order to simplify the manufacturing process and to improve resistance to organic solvents, water and abrasion of the recorded images, and resistance to organic solvents and water of the label including a tackifying layer on the back surface of the receiving paper while controlling the temperature of the emulsion liquid to be not less than the MFT. However, the emulsion having a low MFT tends to cause adhesion between the ink receiving layer and a surface contacting therewith even after the ink receiving layer is dried and a film is formed. Namely the anti-blocking property of the receiving paper deteriorates. In contrast, the anti-blocking property can be improved by including a resin having a glass transition point not less than 45° C. in the receiving layer. In most cases, receiving papers are stored in a roll form at a temperature not greater than 45° C. Therefore the ink receiving layer including an emulsion having a glass transition point not less than 45° C. does not develop adhesion during storage.

Specific examples of emulsions include latexes of a resin such as styrene/butadiene copolymers and styrene/butadiene/acrylic copolymers; and emulsions of a resin such as vinyl acetate resins, vinyl acetate/acrylic copolymers, vinyl chloride resins, vinylidene chloride resins, styrene/acrylic ester copolymers, acrylic ester resins and polyurethane resins. These emulsions can be used alone or in combination.

Among these, polyesters and urethanes are preferable because the recorded labels have dramatically high resistance to organic solvents, water and abrasion, and resistance to organic solvents and water when used as a label including a tackifying layer on the back surface thereof. This is because polyester resins and urethane resins have extremely small solubility to organic solvents and water.

Polyester resins and urethane resins are preferably contained in the ink receiving layer in an amount of from 30 to 100% by weight, and more preferably not less than 40% by weight, based on total weight of the resins included therein.

Furthermore, hollow particles having a hollow rate not less than 50% are included in the ink receiving layer to improve the resistance to organic solvents, water and abrasion of the recorded images. It is believed that by including the hollow particles, cushioning property and heat insulating property of the layer are improved and therefore ink receiving property is improved. Accordingly, the adhesion between the ink receiving layer and an ink component increases, resulting in that the ink components are hardly peeled off from the ink receiving layer when the ink receiving layer is brought into contact with organic solvents and water, or abraded. Although inclusion of hollow particles in an ink receiving layer is known, hollow particles can produce good effect only when the technique is such that the temperature of the emulsion liquid is controlled to be not less than the MFT to improve strength of the film of the ink receiving layer.

Namely, when hollow particles are included in the ink receiving layer with a low film strength condition, components in the ink receiving layer are transferred to a surface of a thermal transfer recording medium during a peeling process which is performed after the ink is transferred onto the ink receiving layer. Even if the amount of the resin contained in the ink receiving layer is increased in order to prevent such a transfer problem of the ink receiving layer, the amount of hollow particles contained in the ink receiving layer has to be decreased, resulting in decrease of the effect of the hollow particles. However, by producing the ink receiving layer with a process such that the temperature of the emulsion is controlled to be not less than the MFT to improve strength of the film of the ink receiving layer, printing can be performed without causing an adverse effect even when a sufficient amount of hollow particles is included. Main components of the hollow particles are preferably resins having high resistance to organic solvents such as acryl, styrene, acrylic-styrene and vinylidene chloride, but not limited thereto.

In addition, when an ink receiving layer has a surface having a smoothness not less than 500 seconds when measured by an Ohken-shiki smoothness tester, the resultant recorded images have better resistance to organic solvents, water and abrasion. When the surface has the smoothness not less than 500 seconds when measured by the Ohken-shiki smoothness tester, the surface of the ink receiving layer can be well contacted with a transfer recording medium and thereby the ink receiving property is improved and the adhesion between the ink receiving layer and ink components is increased. The ink receiving layer having a surface having a smoothness not less than 500 seconds can produce good effect because the ink receiving layer is produced using a process in which the temperature of the surface coating of ink receiving layer material is heated to a temperature not less than a MFT of the emulsion.

Additives such as pigments, fluorescent brightening agents, anti-fading agents, lubricants and the like can be added in the ink receiving layer for the purpose of, for example, improving writing property and anti-blocking property and preventing background yellowing.

In the present invention, an intermediate layer including an aqueous resin and a curing agent as main components can be formed between the substrate and the ink receiving layer, or between the substrate and the tackifying layer. When the receiving paper used as a label having a tackifying layer on the back surface thereof further includes such an intermediate layer, the resistance to organic solvents and water can be dramatically improved, because the intermediate layer develops barrier property against organic solvents and water.

The intermediate layer which is one of the features of the present invention contains a resin and a curing agent as main components. Stated generally, water-soluble or water-dispersible resins or aqueous emulsions of hydrophobic resins (water-dispersible resins) can be used as the resin. Specific examples of most preferable water-soluble resins include polyvinyl alcohol or modified polyvinyl alcohols such as carboxyl, acetoacetyl, methylol, epoxy and alkoxy. In addition, the degrees of polymerization and saponification of these resins greatly influence the film forming property. Deterioration of film forming property results in deterioration of development of the barrier function, and therefore the receiving paper cannot have good resistance to organic solvents and water. Therefore, the degree of polymerization of the resin in the intermediate layer is preferably not less than 800 and the degree of saponification thereof is preferably not less than 85%. Use of a resin having too high a degree of polymerization or too high a degree of saponification causes increase of viscosity of a coating liquid and deteriorates productivity or film forming property. Therefore, proper resins have to be selected for the intermediate layer in consideration of production facilities, etc.

Specific examples of the curing agents for use in the intermediate layer include agents having a reacting active group such as glycidyl, glycidyl amine, methylol amine, epoxy, epichlorohydrin, alkylene imine, isocyanate, aldehyde and the like groups. In addition, for developing a barrier function of an intermediate layer, the curing agents and the above-mentioned resins are preferably used in combination. When the resins and the curing agents are included in different layers, the intermediate layer cannot produce good effects. The ratio of the resin (polyvinyl alcohol or a modified polyvinyl alcohol) to the curing agent is preferably from 9:1 to 5:5. The weight of the intermediate layer is preferably not less than 1 g/m$^2$. If the coated weight amount is less than 1 g/m$^2$, good barrier property cannot be obtained.

The intermediate layer can optionally include inorganic and/or organic fillers. Specific examples of the fillers include calcium carbonates, silicas, titanium oxides, aluminum hydroxides, barium sulfates, clays, talcs, fine powders such as urea-formalin resins, styrene-acryl resins and polystyrene resins. In addition, these inorganic and organic fillers preferably have an oil absorption not greater than 100 ml/100 g. If the oil absorption is greater than 100 ml/100 g, smoothness and barrier property of the resultant film deteriorate.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Receiving Paper (1)

An ink receiving layer forming liquid (1) having the following formula was coated by a wire bar coating method on a high quality paper having a weight of 66 g/m$^2$ as a substrate such that the coating amount was 4.5 g/m$^2$ on a dry basis. The resultant coating of ink receiving layer material was heated; the highest temperature of the coating of ink receiving layer material was 45° C. in this case. Then, the coated substrate was calendered to prepare a receiving paper (1) Smoothness of the surface thereof was 300 seconds.

Preparation of Thermal Transfer Recording Label (1)

Next, a tackifying layer forming liquid having the following formula was coated by a wire bar coating method on a glassine paper having a weight of 60 g/m$^2$ and a surface coated with a silicone release agent as a substrate such that the coating amount was 18 g/m$^2$ on a dry basis. Then the tackifying layer was applied to a backside of the receiving paper (1) to prepare a thermal transfer recording label (1).

Ink Receiving Layer Forming Liquid (1)

| | |
|---|---|
| Aqueous emulsion of styrene-acrylic copolymer (solid content: 30%, MFT: 35° C., Tg: 40° C.) | 50 parts |
| Silica | 5 parts |
| Water | 20 parts |

Tackifying Layer Forming Liquid

| | |
|---|---|
| Aqueous emulsion of acrylic-ester copolymer (solid content: 50%) | 100 parts |

Example 2

Preparation of Receiving Paper (2)

An ink receiving layer forming liquid (2) having the following formula was coated by a wire bar coating method on a high quality paper having a weight of 66 g/m$^2$ as a substrate such that the coating amount was 4.5 g/m$^2$ on a dry basis. The resultant coating was heated; the highest temperature of the coating of ink receiving layer material was 50° C. in this case. Then, the coated substrate was calendered to prepare a receiving paper (2). Smoothness of the surface thereof was 250 seconds.

Preparation of Thermal Transfer Recording Label (2)

The procedure for preparation of the thermal transfer recording label (1) in Example 1 was repeated except that the receiving paper (1) was replaced with the receiving paper (2) to prepare a thermal transfer recording label (2).

Ink Receiving Layer Forming Liquid (2)

| | |
|---|---|
| Aqueous emulsion of acrylic-methacrylic copolymer (solid content: 40%, MFT: 40° C., Tg: 55° C.) | 40 parts |
| Silica | 5 parts |
| Water | 20 parts |

Example 3

Preparation of Receiving Paper (3)

An ink receiving layer forming liquid (3) having the following formula was coated by a wire bar coating method on a high quality paper having a weight of 66 g/m$^2$ as a substrate such that the coating amount was 4.5 g/m$^2$ on a dry basis. The resultant coating was heated; the highest temperature of the coating of ink receiving layer material was 65° C. in this case.

Then, the coated substrate was calendered to prepare a receiving paper (3). Smoothness of the surface thereof was 250 seconds.

Preparation of Thermal Transfer Recording Label (3)

The procedure for preparation of the thermal transfer recording label (1) in Example 1 was repeated except that the receiving paper (1) was replaced with the receiving paper (3) to prepare a thermal transfer recording label (3).

Ink Receiving Layer Forming Liquid (3)

| | |
|---|---|
| Aqueous emulsion of styrene-acrylic copolymer (solid content: 45%, MFT: 0° C., Tg: 5° C.) | 20 parts |
| Aqueous emulsion of polyester resin (solid content: 40%, MFT: 40° C., Tg: 52° C.) | 20 parts |
| Silica | 5 parts |
| Water | 20 parts |

Example 4

Preparation of Receiving Paper (4)

An ink receiving layer forming liquid (4) having the following formula was coated by a wire bar coating method on a high quality paper having a weight of 66 g/m$^2$ as a substrate such that the coating amount was 4.5 g/m$^2$ on a dry basis. The resultant coating was heated; the highest temperature of the coating of ink receiving layer material was 95° C. in this case. Then, the coated substrate was calendered to prepare a receiving paper (4). Smoothness of the surface thereof was 400 seconds.

Preparation of Thermal Transfer Recording Label (4)

The procedure for preparation of the thermal transfer recording label (1) in Example 1 was repeated except that the receiving paper (1) was replaced with the receiving paper (4) to prepare a thermal transfer recording label (4).

Ink Receiving Layer Forming Liquid (4)

| | |
|---|---|
| Aqueous emulsion of acrylic-methacrylic copolymer (solid content: 45%, MFT: 79° C., Tg: 85° C.) | 20 parts |
| Hollow particles (solid content: 50%, hollow rate: 50%, shell material: styrene-acrylic copolymer) | 5 parts |
| Silica | 5 parts |
| Water | 20 parts |

Example 5

Preparation of Receiving Paper (5)

An ink receiving layer forming liquid (5) having the following formula was coated by a wire bar coating method on a high quality paper having a weight of 66 g/m$^2$ as a substrate such that the coating amount was 4.5 g/m$^2$ on a dry basis. The resultant coating was heated; the highest temperature of the coating of ink receiving layer material was 95° C. in this case. Then, the coated substrate was calendered to prepare a receiving paper (5). Smoothness of the surface thereof was 800 seconds.

Preparation of Thermal Transfer Recording Label (5)

The procedure for preparation of the thermal transfer recording label (1) in Example 1 was repeated except that the receiving paper (1) was replaced with the receiving paper (5) to prepare a thermal transfer recording label (5).

Ink Receiving Layer Forming Liquid (5)

| | |
|---|---|
| Aqueous emulsion of acrylic-methacrylic copolymer (solid content: 45%, MFT: 79° C., Tg: 85° C.) | 15 parts |
| Aqueous emulsion of polyurethane resin (solid content: 40%, MFT: 13° C., Tg: 26° C.) | 15 parts |
| Hollow particles (solid content: 50%, hollow rate: 50%, shell material: styrene-acrylic copolymer) | 5 parts |
| Silica | 5 parts |
| Water | 20 parts |

Example 6

Preparation of Intermediate Layer (1)

An intermediate layer forming liquid (1) having the following formula was coated by a wire bar coating method on a high quality paper having a weight of 66 g/m$^2$ as a substrate such that the coating amount was 3.0 g/m$^2$ on a dry basis to prepare an intermediate layer (1).

Preparation of Receiving Paper (6)

Then an ink receiving layer forming liquid (6) having the following formula was coated by a wire bar coating method on the intermediate layer (1) such that the coating amount was 4.5 g/m$^2$ on a dry basis. The resultant coating was heated; the highest temperature of the coating of ink receiving layer material was 95° C. in this case. Then, the coated substrate was calendered to prepare a receiving paper. Smoothness of the surface thereof was 1200 seconds.

Preparation of Thermal Transfer Recording Label (6)

The procedure for preparation of the thermal transfer recording label (1) in Example 1 was repeated except that the receiving paper (1) was replaced with the receiving paper (6) to prepare a thermal transfer recording label (6).

Intermediate Layer Forming Liquid (1)

| | |
|---|---|
| 5% aqueous solution of dialdehydo starch | 20 parts |
| glyoxal | 5 parts |
| aluminum hydroxide powder | 2 parts |
| Water | 73 parts |

Ink Receiving Layer Forming Liquid (6)

| | |
|---|---|
| Aqueous emulsion of acrylic-methacrylic copolymer (solid content: 45%, MFT: 79° C., Tg: 85° C.) | 15 parts |
| Aqueous emulsion of polyurethane resin (solid content: 40%, MFT: 13° C., Tg: 26° C.) | 15 parts |
| Hollow particles (solid content: 40%, hollow rate: 90%, shell material: vinylidene chloride-methacrylic methyl copolymer) | 10 parts |
| Silica | 5 parts |
| Water | 20 parts |

Example 7

Preparation of Intermediate Layer (2)

An intermediate layer forming liquid (2) having the following formula was coated by a wire bar coating method on a high quality paper having a weight of 66 g/m$^2$ as a substrate such that the coating amount was 3.0 g/m$^2$ on a dry basis. The dried material was allowed to settle for 3 hours under an environmental condition of 40° C. to prepare an intermediate layer (2).

Preparation of Receiving Paper (7)

Then the ink receiving layer forming liquid (6) was coated by a wire bar coating method on the intermediate layer (2) such that the coating amount was 4.5 g/m$^2$ on a dry basis. The resultant coating was heated; the highest temperature of the coating of ink receiving layer material was 105° C. in this case. Then, the coated substrate was calendered to prepare a receiving paper. Smoothness of the surface thereof was 700 seconds.

Preparation of Thermal Transfer Recording Label (7)

The procedure for preparation of the thermal transfer recording label (1) in Example 1 was repeated except that the receiving paper (1) was replaced with the receiving paper (7) to prepare a thermal transfer recording label (7).

Intermediate Layer Forming Liquid (2)

| | |
|---|---|
| 10% aqueous solution of carboxyl group modified polyvinyl alcohol | 50 parts |
| 12.5% aqueous solution of polyamide epichlorohydrin resin | 10 parts |
| aluminum hydroxide powder | 2 parts |
| Water | 81 parts |

Example 8

Preparation of Intermediate Layer (3)

An intermediate layer forming liquid (3) having the following formula was coated by a wire bar coating method on a high quality paper having a weight of 66 g/m$^2$ as a substrate such that the coating amount was 3.0 g/m$^2$ on a dry basis. The dried material was kept 3 hours under an environmental condition of 40° C. to prepare an intermediate layer (3).

Preparation of Receiving Paper (8)

Then an ink receiving layer forming liquid (7) having the following formula was coated by a wire bar coating method on the intermediate layer (3) such that the coating amount was 4.5 g/m$^2$ on a dry basis. The resultant coating was heated; the highest temperature of the coating of ink receiving layer material was 105° C. in this case. Then, the coated substrate was calendered to prepare a receiving paper. Smoothness of the surface thereof was 700 seconds.

Preparation of Thermal Transfer Recording Label (8)

The procedure for preparation of the thermal transfer recording label (1) in Example 1 was repeated except that the receiving paper (1) was replaced with the receiving paper (8) to prepare a thermal transfer recording label (8).

Intermediate Layer Forming Liquid (3)

| | |
|---|---|
| 10% aqueous solution of carboxyl group modified polyvinyl alcohol | 50 parts |
| polyamide epichlorohydrin resins | 10 parts |
| aluminum hydroxide powder s | 2 parts |
| Water | 81 parts |

Ink Receiving Layer Forming Liquid (7)

| | |
|---|---|
| Aqueous emulsion of acrylic-methacrylic copolymer (solid content: 45%, MFT: 79° C., Tg: 85° C.) | 19 parts |
| Aqueous emulsion of polyurethane resins (solid content: 40%, MFT: 13° C., Tg: 26° C.) | 11 parts |
| Hollow particles (solid content: 40%, hollow rate: 90%, shell material: vinylidene chloride-methacrylic methyl copolymer) | 10 parts |
| Silica | 5 parts |
| Water | 20 parts |

Comparative Example 1

Preparation of Receiving Paper (9)

An ink receiving layer forming liquid (8) having the following formula was coated by a wire bar coating method on a high quality paper having a weight of 66 g/m$^2$ as a substrate such that the coating amount was 4.5 g/m$^2$ on a dry basis. The resultant coating was heated; the highest temperature of the coating of ink receiving layer material was 45° C. in this case. Then, the coated substrate was calendered to prepare a receiving paper (9). Smoothness of the surface thereof was 350 seconds.

Preparation of Thermal Transfer Recording Label (9)

The procedure for preparation of the thermal transfer recording label (1) in Example 1 was repeated except that the receiving paper (1) was replaced with the receiving paper (9) to prepare a thermal transfer recording label (9).

Ink Receiving Layer Forming Liquid (8)

| | |
|---|---|
| Aqueous emulsion of acrylic-methacrylic copolymer (solid content: 45%, MFT: 79° C., Tg: 85° C.) | 15 parts |
| Silica | 5 parts |
| Water | 20 parts |

Comparative Example 2

Preparation of Receiving Paper (10)

An ink receiving layer forming liquid (9) having the following formula was coated by a wire bar coating method on a high quality paper having a weight of 66 g/m$^2$ as a substrate such that the coating amount was 4.5 g/m$^2$ on a dry basis. The resultant coating was heated; the highest temperature of the coating of ink receiving layer material was 48° C. in this case. Then, the coated substrate was calendered to prepare a receiving paper (10). Smoothness of the surface thereof was 350 seconds.

Preparation of Thermal Transfer Recording Label (10)

The procedure for preparation of the thermal transfer recording label (1) in Example 1 was repeated except that the receiving paper (1) was replaced with the receiving paper (10) to prepare a thermal transfer recording label (10).

Ink Receiving Layer Forming Liquid (9)

| | |
|---|---|
| Aqueous emulsion of polyvinylidene chloride (solid content: 42%, MFT: 53° C., Tg: 65° C.) | 20 parts |
| Hollow particles (solid content: 50%, hollow rate: 50%, shell material: styrene-acrylic copolymer) | 5 parts |

-continued

| | |
|---|---|
| Silica | 5 parts |
| Water | 20 parts |

Comparative Example 3

Preparation of Intermediate Layer (4)

The intermediate layer forming liquid (1) was coated by a wire bar coating method on a high quality paper having a weight of 66 g/m2 as a substrate such that the coating amount was 3.0 g/m$^2$ on a dry basis to prepare the intermediate layer (4).

Preparation of Receiving Paper (11)

Then an ink receiving layer forming liquid (10) having the following formula was coated by a wire bar coating method on the intermediate layer (4) such that the coating amount was 4.5 g/m$^2$ on a dry basis. The resultant coating was heated; the highest temperature of the coating of ink receiving layer material was 35° C. in this case. Then, the coated substrate was calendered to prepare a receiving paper. Smoothness of the surface thereof was 800 seconds.

Preparation of Thermal Transfer Recording Label (11)

The procedure for preparation of the thermal transfer recording label (1) in Example 1 was repeated except that the receiving paper (1) was replaced with the receiving paper (11) to prepare a thermal transfer recording label (11).

Ink Receiving Layer Forming Liquid (10)

| | |
|---|---|
| Aqueous emulsion of acrylic-methacrylic copolymer (solid content: 45%, MFT: 38° C., Tg: 42° C.) | 15 parts |
| Hollow particles (solid content: 40%, hollow rate: 90%, shell material: polyvinylidene chloride-methacrylic methyl copolymer) | 10 parts |
| Silica | 5 parts |
| Water | 20 parts |

Evaluation Items and Methods

Preparation of Thermal Transfer Recording Medium

A separation layer forming liquid having the following formula was coated by a wire bar coating method on a side of a PET film as a substrate having a thickness of 4.5 μm and a heat resistant lubricative layer on another side thereof, such that the coating amount was 0.5 g/m$^2$ on a dry basis to form a separation layer on the substrate.

Next, an ink layer forming liquid having the following formula was coated on the separation layer such that the coating amount was 1.2 g/m$^2$ on a dry basis to prepare a thermal transfer recording medium.

Separation Layer Forming Liquid

| | |
|---|---|
| Polyethylene wax (POLYWAX 850 manufactured by Toyo Petrolite Co., Ltd.) | 10 parts |
| Butadiene rubber (5% solution of toluene, BON RI-1 manufactured by Konishi Co., Ltd.) | 10 parts |
| Ethylene-vinylacetate resin (EVANFLEX EV 250 manufactured by Du Pont-Mitsui Polychemicals Co., Ltd.) | 0.2 parts |
| Toluene | 79.8 parts |

Ink Layer Forming Liquid

| | |
|---|---|
| Carbon black | 5 parts |
| Polyester resin (NICHIGO POLYESTER TP295 manufactured by Nippon Synthetic Chemical Industry Co., Ltd.) | 10 parts |
| Carnauba wax | 4 parts |
| Methyl ethyl ketone | 81 parts |

1. Evaluation of Printed Images

Images were printed on each thermal transfer recording label under the following conditions.

Printing Conditions

Thermal head: partially glazed thin film head (8 dot/mm)
Platen pressure: 150 g/cm
Release angle of the recording medium: 30°
Release torque: 200 g
Printing speed: 100 mm/sec 1-1 Transfer of Ink Receiving Layer After images were printed on a thermal transfer recording label using a thermal transfer recording medium, the thermal transfer recording medium was observed with the naked eye to determine whether the ink receiving layer was transferred to the thermal transfer recording medium.

1-2 Ethanol Resistance of the Printed Image

Under the above-mentioned printing conditions, vertical barcodes were printed on each thermal transfer recording label with a printing energy of +1.0 mj/mm$^2$ to prepare printed samples for evaluation.

The printed images on which ethanol was dropped, were rubbed 100 times by a cotton cloth with a pressure of 200 g/m$^2$ to observe the conditions of the surfaces. The resistance to ethanol was evaluated by classifying into the following ranks:

○: The image was not damaged at all
Δ: The image was partially damaged
X: The image was totally damaged 1-3 Water Resistance of the Printed Image The procedure for preparation of the printed image mentioned above in the paragraph 1-2 was repeated.

The thus prepared printed image was dipped into water for 24 hours, and then rubbed 10 times by a finger to observe the conditions of the surfaces. Resistance to water was evaluated by classifying into the following ranks:

○: The image was not damaged at all
Δ: The image was partially damaged
X: The image was totally damaged 1-4 Abrasion Resistance of the Printed Image The procedure for preparation of the printed image mentioned in the above paragraph 1-2 was repeated.

Printed image portions of the thus prepared printed samples were abraded 1000 times by a pen scanner with a pressure of about 1 Kg/m$^2$ at a speed of 50 cm/sec to observe the conditions of the surfaces. The abrasion resistance was evaluated based on whether the resultant image was damaged.

2 Anti-blocking Property

Each thermal transfer recording label was wound on a paper core having an outer diameter of 3 inches. The roll samples were allowed to settle for 24 hours under an environmental condition of 40° C. 80% RH. Then the roll samples were released while observing whether blocking occurs between the ink receiving layer surface and the glassine paper. The anti-blocking property was classified into the following ranks:

○: Not blocked

Δ: Slightly blocked (The label could be easily peeled off by hands and a trace did not remain)

X: Blocked (A trace of blocking remained when the label was peeled off by hands)

3. Adhesion of Thermal Transfer Recording Label

Adhesion of samples of thermal transfer recording labels prepared in Examples 1 to 8 and Comparative Examples 1 to 3 were measured.

3-1 Initial Adhesion

Each thermal transfer recording label was cut into sheets of 2.5 cm×10 cm and the release paper adhered on the back surface thereof was peeled off and the label was attached to an adherend (aluminum plate). Then the label was peeled at a peel speed of 300 mm/min and a peel angle of 180° C. to measure resistance to peeling, i.e., to evaluate the initial adhesion in units of kgf/cm.

3-2 Resistance to Alcohol of Adhered Label

Each thermal transfer recording label was cut into sheets of 2.5 cm×10 cm and the release paper adhered on the back surface thereof was peeled off and the label was attached to an adherend (aluminum plate). Then ethanol was dropped onto the surface of the ink receiving layer of the label. After 2 minutes, adhesion thereof was measured by the same method as mentioned in paragraph 3-1 to evaluate the resistance to ethanol of adhered label in units of kgf/cm. The higher the adhesion, the better the resistance to ethanol.

3-3 Resistance to Gasoline of Adhered Label

The procedure of 3-2 was repeated except that ethanol was replaced with gasoline to evaluate the resistance to gasoline of adhered label in units of kgf/cm. The higher the adhesion, the better the resistance to gasoline.

3-4 Resistance to Water of Adhered Label

The procedure of 3-2 was repeated except that ethanol was replaced with water to evaluate the resistance to water of adhered label in units of kgf/cm. The higher the adhesion, the better the resistance to water.

TABLE 1

| | | Durability of printed image | | |
|---|---|---|---|---|
| | Transfer of ink receiving layer | Resistance to ethanol | Resistance to water | Resistance to abrasion |
| Example 1 | No | Δ | Δ | Not damaged |
| Example 2 | No | Δ | Δ | Not damaged |
| Example 3 | No | ○ | ○ | Not damaged |
| Example 4 | No | Δ | ○ | Not damaged |
| Example 5 | No | ○ | ○ | Not damaged |
| Example 6 | No | ○ | ○ | Not damaged |
| Example 7 | No | ○ | ○ | Not damaged |
| Example 8 | No | ○ | ○ | Not damaged |
| Comparative Example 1 | No | X | ○ | Damaged |
| Comparative Example 2 | Yes | Δ | Δ | Damaged |
| Comparative Example 3 | Yes | Δ | Δ | Damaged |

| | Anti-blocking property | Initial adhesion | Resistance to ethanol | Resistance to gasoline | Resistance to water |
|---|---|---|---|---|---|
| Example 1 | Δ | 1.62 | 1.30 | 1.31 | 1.40 |
| Example 2 | ○ | 1.60 | 1.31 | 1.29 | 1.38 |
| Example 3 | Δ | 1.58 | 1.38 | 1.35 | 1.39 |
| Example 4 | ○ | 1.65 | 1.41 | 1.42 | 1.41 |
| Example 5 | ○ | 1.68 | 1.43 | 1.44 | 1.49 |
| Example 6 | ○ | 1.68 | 1.50 | 1.50 | 1.54 |
| Example 7 | ○ | 1.65 | 1.63 | 1.60 | 1.60 |
| Example 8 | ○ | 1.65 | 1.51 | 1.55 | 1.52 |
| Comparative Example 1 | ○ | 1.59 | 0.65 | 0.69 | 1.00 |
| Comparative Example 2 | ○ | 1.60 | 0.67 | 0.71 | 1.00 |
| Comparative Example 3 | X | 1.60 | 0.69 | 0.72 | 1.01 |

Additional modifications and variations of the present invention are possible in light of the above teachings. It is therefore to be understood that within the scope of the appended claims the invention may be practiced other than as specifically described herein.

This document claims priority of and contains subject matter related to Japanese Patent Application No. 2002-227690 filed on Aug. 5, 2002, the entire contents of which are herein incorporated by reference.

What is claimed is:

1. A receiving paper for thermal transfer recording comprising:

a paper substrate having opposed surfaces;

an ink receiving layer located overlying one surface of the paper substrate and configured to receive a heat-melted or heat-softened ink; and a tackifying layer located overlying the other surface of the paper substrate, wherein the ink receiving layer is formed by a method comprising:

providing a coating of an ink receiving layer forming liquid comprising a resin emulsion overlying the paper substrate, the emulsion having a minimum filming temperature and wherein the resin emulsion comprises a resin having a glass transition point of not less than 45 C; and heating the coating of ink layer forming liquid to a temperature not less than the minimum filming temperature of the resin emulsion; and wherein the ink receiving layer further comprises a hollow particulate material having a hollow rate not less than 50%.

2. The receiving paper for thermal transfer recording according to claim 1, wherein the resin emulsion is an emulsion selected from the group consisting of polyester resin emulsions and urethane resin emulsions.

3. The receiving paper for thermal transfer recording according to claim 1, wherein the ink receiving layer has a surface having a smoothness not less than 500 seconds when measured by an Ohken-shiki smoothness tester.

4. A receiving paper for thermal transfer recording comprising:

a paper substrate having opposed surfaces;

an ink receiving layer located overlying one surface of the paper substrate and configured to receive a heat-melted or heat-softened ink; and a tackifying layer located overlying the other surface of the paper substrate, wherein the ink receiving layer is formed by a method comprising:

providing a coating of an ink receiving layer forming liquid comprising a resin emulsion overlying the paper substrate, the emulsion having a minimum filming temperature; and heating the coating of ink layer forming liquid to a temperature not less than the minimum filming temperature of the resin emulsion, said receiving paper for thermal transfer recording further comprising:

an intermediate layer comprising a resin and a curing agent thereof as main components at least at one of a location between the paper substrate and the ink receiving layer, and a location between the substrate and the tackifying layer.

5. The receiving paper for thermal transfer recording according to claim 4, wherein the resin in the intermediate layer is a resin selected from the group consisting of polyvinyl alcohols and modified polyvinyl alcohols.

6. The receiving paper for thermal transfer recording according to claim 4, wherein the resin emulsion comprises a resin having a glass transition point not less than 45° C.

7. The receiving paper for thermal transfer recording according to claim 4, wherein the resin emulsion is an emulsion selected from the group consisting of polyester resin emulsions and urethane resin emulsions.

8. The receiving paper for thermal transfer recording according to claim 4, wherein the ink receiving layer further comprises a hollow particulate material having a hollow rate not less than 50%.

9. The receiving paper for thermal transfer recording according to claim 4, wherein the ink receiving layer has a surface having a smoothness not less than 500 seconds when measured by an Ohken-shiki smoothness tester.

* * * * *